US006769943B1

(12) United States Patent
Abell

(10) Patent No.: US 6,769,943 B1
(45) Date of Patent: Aug. 3, 2004

(54) PERSONAL MARINE WINTERIZING SYSTEM

(76) Inventor: James T. Abell, 3668 Waterwheel Sq., Randallstown, MD (US) 21133

( * ) Notice: Subject to any disclaimer, the term of this patent is extended or adjusted under 35 U.S.C. 154(b) by 0 days.

(21) Appl. No.: 10/618,305

(22) Filed: Jul. 14, 2003

(51) Int. Cl.[7] ..... B63H 21/10
(52) U.S. Cl. ..... 440/88 N
(58) Field of Search ..... 440/88 N

(56) References Cited

U.S. PATENT DOCUMENTS

| | | | | |
|---|---|---|---|---|
| 5,069,259 | A | | 12/1991 | Ahlefeld |
| 5,263,885 | A | | 11/1993 | Montague |
| 5,337,774 | A | * | 8/1994 | Boyd ..... 137/1 |
| 5,362,265 | A | | 11/1994 | Gervais |
| 5,676,182 | A | | 10/1997 | McMullen, Jr. et al. |
| 5,845,684 | A | * | 12/1998 | Fletcher et al. ..... 141/98 |
| 6,165,033 | A | | 12/2000 | Cugini |
| 6,206,740 | B1 | * | 3/2001 | Sholler ..... 440/88 R |
| ,069,912 | A1 | | 6/2002 | Prentice |

OTHER PUBLICATIONS

American Auto Parts catalogue, p. 632, 2002.
Yardarm Marine Products, Inc., Internet catalogue, Indianapolis, Indiana, Mar. 2001.

* cited by examiner

*Primary Examiner*—Stephen Avila
(74) *Attorney, Agent, or Firm*—Richard C. Litman

(57) ABSTRACT

A wheeled, open reservoir having a hood like splash guard extending upward from the rear wall and opening forward. Swivel front wheels allow placement relative to a boat outdrive. A high pressure pump is mounted forward of the front wall and protected from the solution by the splash guard and is part of a circulation system having a pickup hose, a strainer, and a faucet type valve, to deliver high pressure fluid, controlled by the valve, to an applications supply hose which is connected to an "ear muff" connection with the cooling water opening of an outdrive of an inboard/outboard marine engine and drive or an outboard motor and drive, or, alternatively, connected to a trigger sprayer valve controlling winterizing fluid to a connecting line for an inboard marine engine or boat water system. There may be a re-circulation line to the system reservoir.

16 Claims, 7 Drawing Sheets

PERSONAL MARINE WINTERIZING SYSTEM

BACKGROUND OF THE INVENTION

1. Field of the Invention

The present invention relates to boats. More particularly, the present invention relates to a system for winterizing boats having water cooled engines and/or water systems such as are used in the galley and head to avoid freezing damage to the boat.

2. Description of the Related Art

Marine winterizing system for flushing boat engine cooling water systems with an antifreeze solution for winter storage are known. These systems are useful for winterizing engines to avoid freezing damage to the engine, however, they do not provide facility to winterize other water cooled or containing systems such as heads, galleys, electrical generators, hot water heaters, water storage tanks, and tubing providing for flow of fresh water throughout the boat or marine water, depending on water and cooling systems design. These systems generally depend upon gravity, or a low-pressure bilge pump to pump flushing and winterizing fluids through the engine. Some are permanent installations requiring maneuvering of the boat to the flushing site. Others are portable, however they are useful only for engine flushing and winterizing. Known winterizing systems employ only gravity or sump or bilge pump which has practical limitations on pressure output. It would be desirable to provide a relatively high pressure and flow capacity pumped flush and winterizing system which is effective to provide for flushing fluid flow at high rate pressure relative to prior systems, which would reduce flushing time and enhance flushing effectiveness in boat engines, particularly inboard/outboard type engines. It would also be desirable that the same system may be useful to flush and winterize other water systems in the boat such as generator and refrigerator systems, hot water heater, head, shower, galley, fresh water tanks, and hoses or pipes connecting these systems with minimum effort and time spent. It would also be desirable to provide such as system which is portable so as to allow winterizing of the boat while stored on blocks, cradles, or trailers for the winter without moving the boat.

U.S. Patent application publication No. 00699112 A1, published Jun. 13, 2002, for Prentice, describes a marine engine winterizing system and procedure that is a permanent installation, and is useful for flushing and winterizing a marine engine which makes both a powered and hand-operated pump available for circulating fluids.

U.S. Pat. No. 5,069,259, issued Dec. 3, 1991, to Ahlefeld, describes a system for providing flushing and winterizing fluid to the outdrive and then to the engine of an inboard/outboard marine engine.

U.S. Pat. No. 5,263,885, issued Nov. 23, 1993, to Montague, describes an on-board, permanently installed electronic controlled marine engine and outdrive flushing and dewinterizing system.

U.S. Pat. No. 5,362,265, issued Nov. 8, 1994, to Gervals, describes an outdrive "earmuff" flushing connector as employed by the present invention but the system of Gervals is limited to flushing the outdrive and marine engine.

U.S. Pat. No. 5,676,182, issued Oct. 14, 1997, to McMullen, Jr. et al., describes a method and apparatus for winterizing a seasonal dwelling water system.

U.S. Pat. No. 5,725,403, issued Mar. 10, 1998, to Ridolfo, describes an outboard motor flush and run tank and method of flushing a marine outboard motor.

U.S. Pat. No. 6,165,033, issued Dec. 26, 2000, to Cugini, describes a flushing and winterizing system for an inboard/outboard marine motor employing a low pressure circulating immersion pump in a portable catch basin and a pair of "earmuff" connectors for circulation to the outdrive. CAMCO Do-It-Yourself Boat Winterizer, American Auto Parts catalogue, Page 632, 2002 illustrates a personal marine engine winterizer employing connection to an outdrive to an inboard/outboard drive. No provision is made for flushing and winterizing boat water systems.

Yardarm Winterizing Tank, Yardarm Marine Products, Inc. internet catalogue, Indianapolis, Ind., Mar. 6, 2001 illustrates a winterizing tank for attachment to the outdrive to an inboard/outboard drive. No provision is made for flushing and winterizing the boat water systems.

None of the above inventions and patents, taken either singly or in combination, is seen to describe the instant invention as claimed. Thus a personal marine winterizing system solving the aforementioned problems is desired.

SUMMARY OF THE INVENTION

The personal marine winterizing system is a generally rectangular open reservoir having a handle in the front wall and a splash guard extending upward from the rear wall and extending around the rear portion of the sidewalls to maintain flushing and antifreeze solution in the reservoir within the reservoir during movement and use of the system. The reservoir has a pair of large supporting wheels mounted for rotation on the opposite sides of the rear end and a pair of swivel wheels mounted for rotation and swivel on opposite sides of the front end, thus providing a high degree of manual maneuverability to help position the winterizing system to a desired location at the stern of a boat.

A high pressure pump is mounted forward of the front wall and protected from the solution by the splash guard. The high pressure pump is part of a circulation system having a pickup hose in the reservoir, a fitting through the end wall, a strainer, a pump, and a faucet type valve, along with associated tubing to deliver high pressure fluid, controlled by the valve, to a delivery hose. The hose may be connected to an "ear muff" connection with the cooling water opening of an outdrive of an inboard/outboard marine engine and drive or an outboard motor and drive. The hose may, alternatively, be connected to a garden hose type trigger sprayer valve or the like which controls delivery of pressurized fluid to a connecting line which may be connected, as convenient, with an inboard marine engine or boat water system to pump winterizing fluid to pump flushing or winterizing fluid therethrough. There may be a re-circulation line appropriately attached to the marine engine or the boat water system to return flushing fluid to the system reservoir.

Accordingly, it is a principal object of the invention to provide a marine winterizing system which provides for high pressure flushing and winterizing the engine and water system of a marine vessel.

It is another object of the invention to provide a winterizing system as above which is easily moved into position, utilized, and moved to storage manually.

It is a further object of the invention to provide a winterizing system as above which does not require dock space.

Still another object of the invention is to provide a winterizing system of above which is powered by a 12-volt battery or a "Hot Shot" device.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
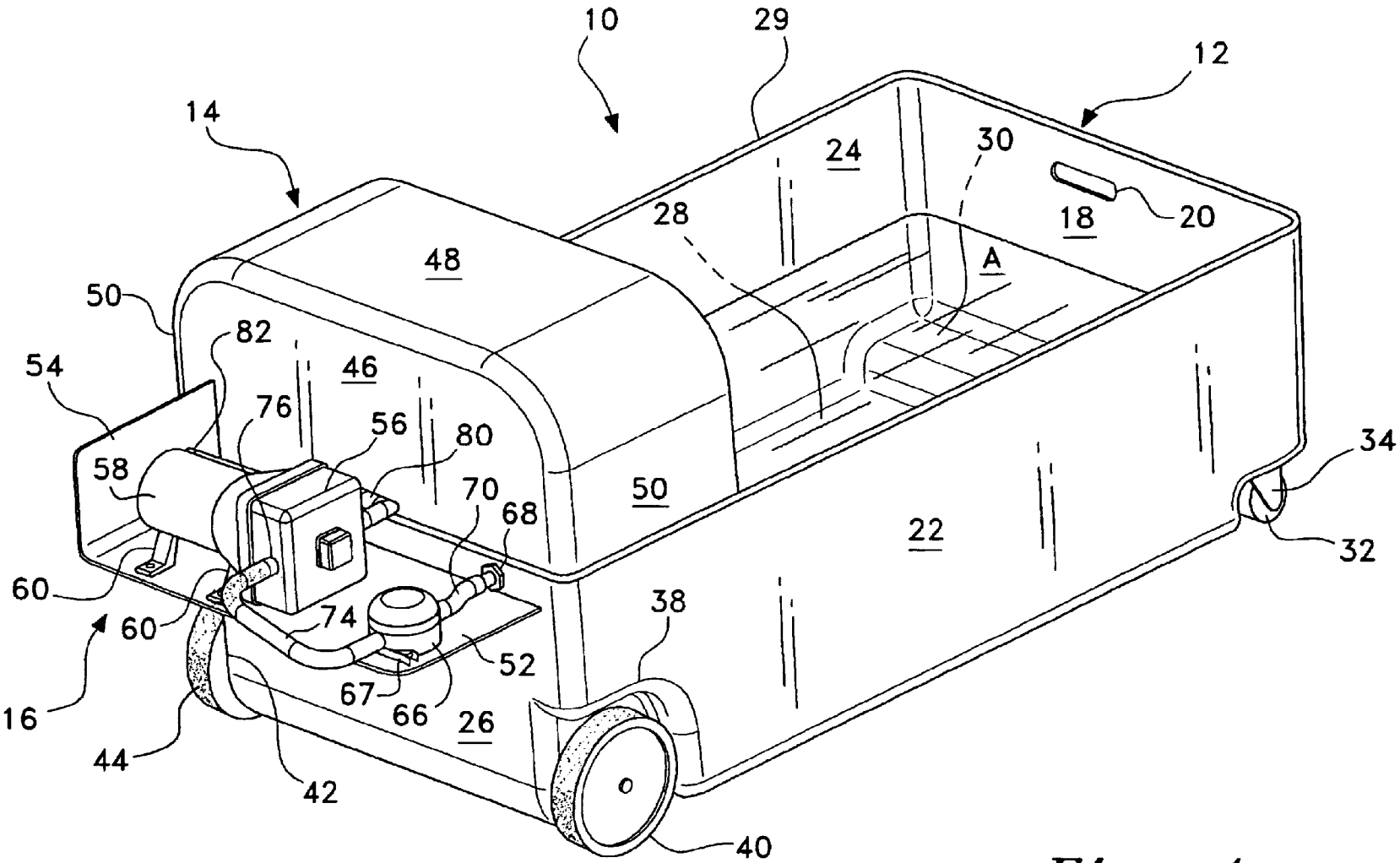
FIG. 1 is an environmental, upper right rear perspective view of a personal marine winterizing system according to the present invention.

The present invention is a manually transportable marine winterizing system which, in one embodiment, is connectable to a marine outdrive for a flushing and placing antifreeze into a marine engine, and in another embodiment is useful for flushing and winterizing inboard marine engines and boat water systems.

Referring to the drawings, personal marine dewinterizer system 10 has an open reservoir 12 having a splash guard 14 extending upward from the rear portion of reservoir 12. The reservoir normally carries an antifreeze solution A to a desired level. A fluid circulating system 16 is mounted on the rear of reservoir 12 so as to be protected from contact with fluid by splash guard 14. The reservoir is generally elongated and rectangular in shape, and preferably having rounded corners to promote structural integrity and ease of removal from a forming mold when constructed of material such as plastic. The reservoir has a front wall 18 having a handle 20 shown as a cutout in front wall 18 to ease manipulation of the location of the system 10 by a worker. The reservoir has an elongated left wall 22 and opposite right wall 24 defining rear end wall 26 and bottom wall 28, the reservoir being open to the atmosphere at reservoir rim 29. The reservoir has an elongated rear wheel housing 30 extending along the length of front wall 18 and bottom wall 28 and has opposing wheels 32 mounted on swivels 34 to allow easy maneuverability of the system 10 to the rear of a boat or vessel. Opposed rear wheel wells 38, have relatively large front wheels 32 mounted for rotation therein.

Splash guard 14 is preferably in the form of a hood and may be integral with system reservoir 12 or removably mounted thereon in a known manner such as fasteners(not shown. Splash guard 14 has a rear wall 46, a hood top 14, and hood side walls 50 extending along each side of reservoir 12, splash guard 14 opening forwardly toward the reservoir front wall 18. Recirculating system support wall 52 is supported rearwardly and generally horizontally by rear end wall 26 and supports circulating system 16. A vertically oriented, faucet type valve support wall 54 extends upward from the right end of system support wall 52. Circulating system 16 is of commercially available design and includes a high pressure pump 56 having a high pressure pump motor 58 and supported by support wall 52.

Pump electrical supply cord 62 extends from a power source by connectors 65 to pump on-off switch 64 mounted on support wall 52 and then extends to pump motor 58 in a well known manner(not shown). Circulating system 16 has a pump input strainer 66 of commercially available design having mounts 67 for mounting to support wall 52 by fasteners of common design. A through-wall fitting 68 is located on end wall 26 and provides liquid communication between suction supply hose 72 and strainer supply hose 70 for pickup and supply of fluid from reservoir 12 to circulating system 16. An elbow connection 73 is preferred for attaching suction supply hose 70 to through-wall fitting 68. Pump 56 has an inlet hose 74 extending from strainer 66 for supplying fluid to pump inlet 76.

High pressure fluid from pump outlet 78 is directed by pump outlet hose 80 to high pressure faucet-like valve 88 which is supported by support wall 54 at an appropriate height by means of high pressure fitting inlet 82 extending through support wall 54. High pressure control valve 88 has a threaded or snap release fitting outlet 84 for connection with high pressure application supply hose 86, the flow thereto being controlled by valve 88. A trigger-type nozzle 90 (shown as removably clipped to reservoir rim 29) is attached to the outlet end of supply hose 86, further controlling the flow of fluid though circulating system 16. A supply connector 92 (shown as a truncated tube) is attached at an inlet end to nozzle 90 by a threaded or otherwise configured nozzle attachment 94.

The supply connector is of such length and configuration as to fit a coolant system for the marine engine or appropriate points in the water supply system of the boat or vessel. Such systems are well known and are not illustrated, such being well known in cruising type boats. The water supply system typically has a fresh water storage tank, a hot water heater, a shower and lavatory of the head, and a galley water faucet. The inventive system may also be fitted, as appropriate, to sea water system such as the flushing system of a head and a galley pumped sea water supply system. The inventive system may be so configured and have such connectors as necessary to flush and winterize boat water systems individually in a serial manner or as a unit as desired. A fluid return hose 95 (shown as a truncated hose) may be fitted to a marine engine cooling system and boat water supply so as to return flushing and winterizing fluid to reservoir 12.

Figure 2:
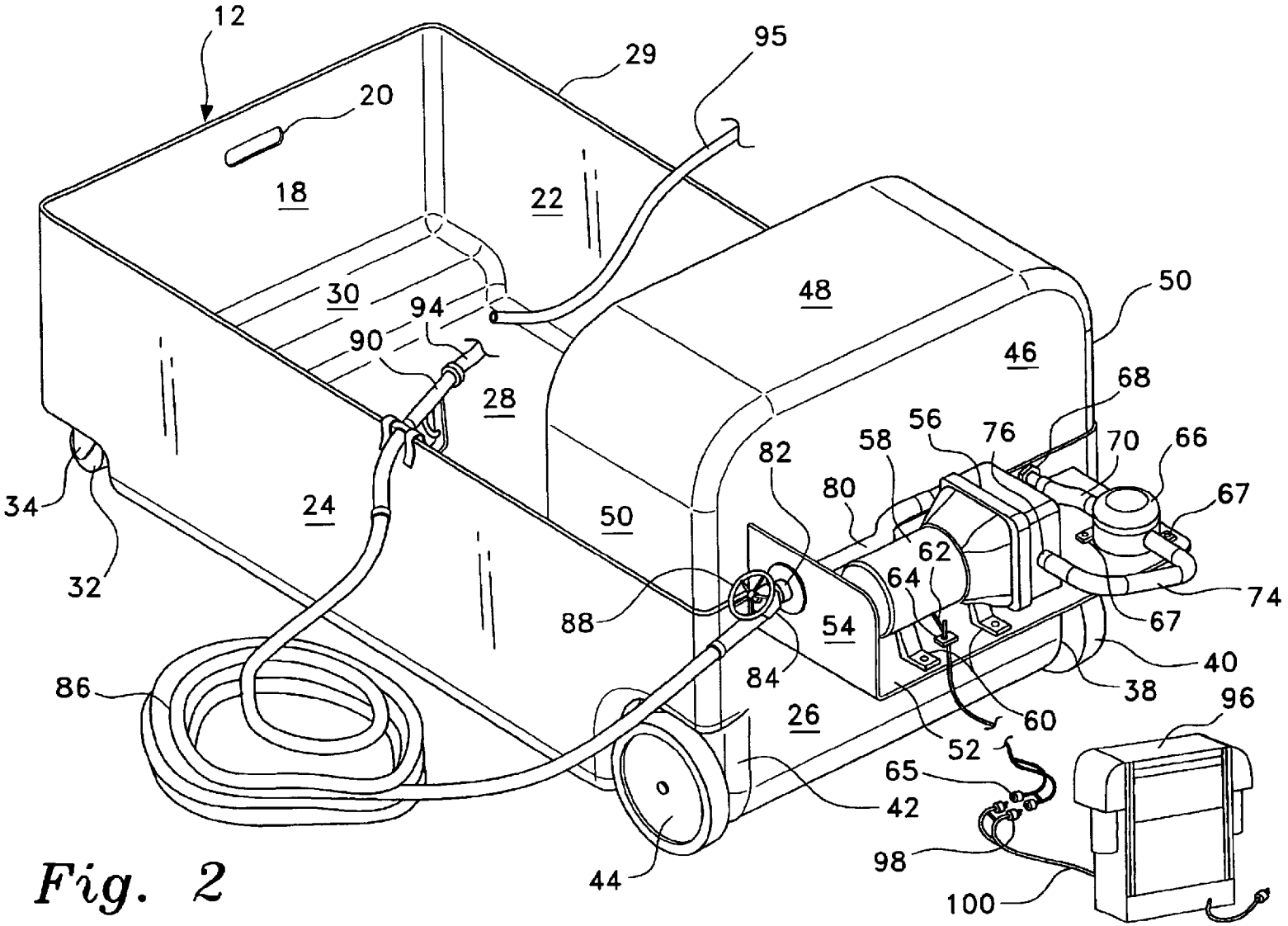
FIG. 2 is an environmental, upper left rear perspective of the system of FIG. 1.

As shown in FIG. 2, "Hot Shot" 12-volt electrical supply 96, having electrical connectors 98 supplied by electrical supply cord 100 mate with supply cord and connectors 65 to provide electrical power to operate high pressure pump 56.

Figure 3:
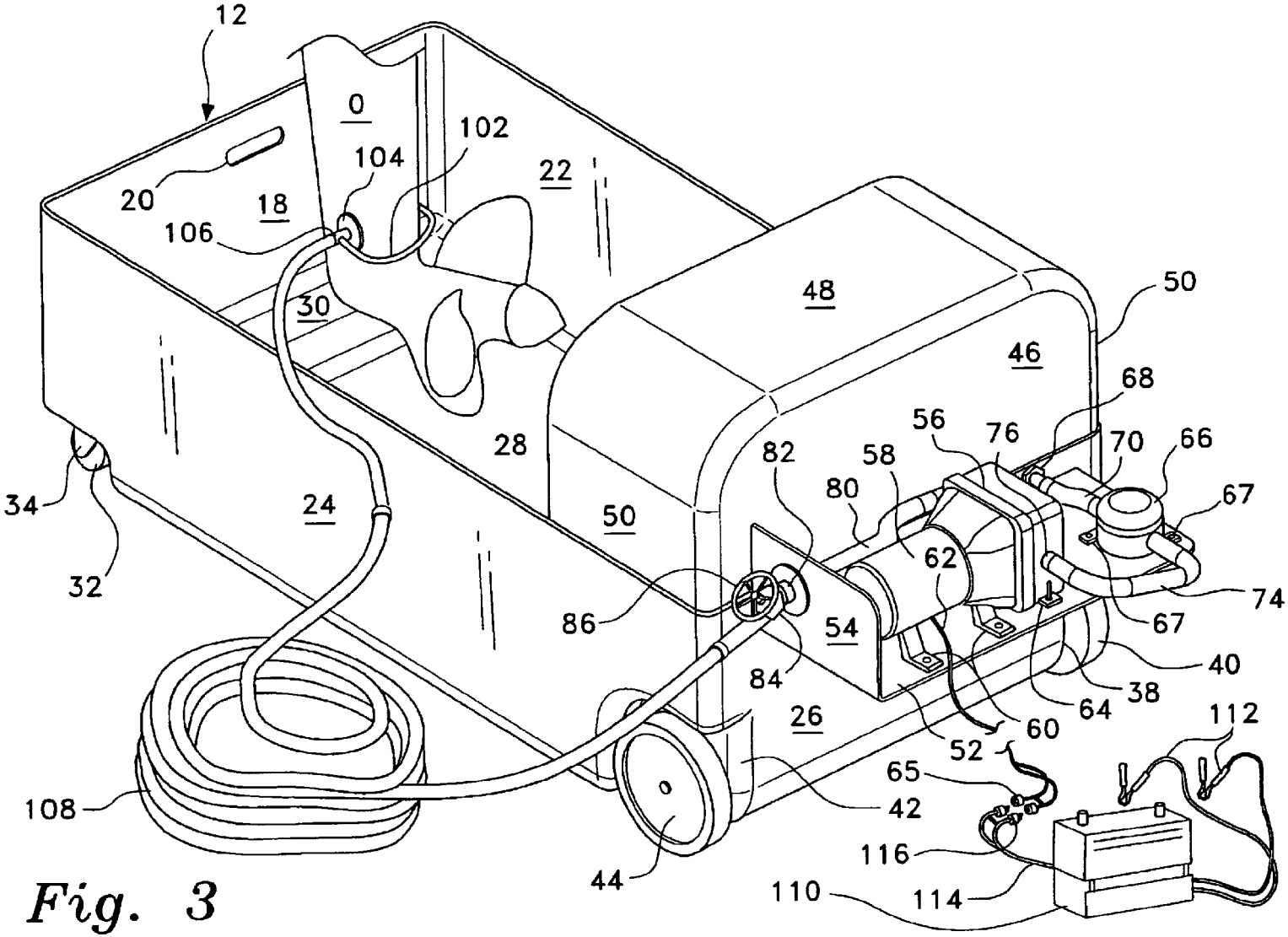
FIG. 3 is a perspective view as in FIG. 2, showing ear-muff type hose connection to an outdrive of a marine engine.
Figure 4:
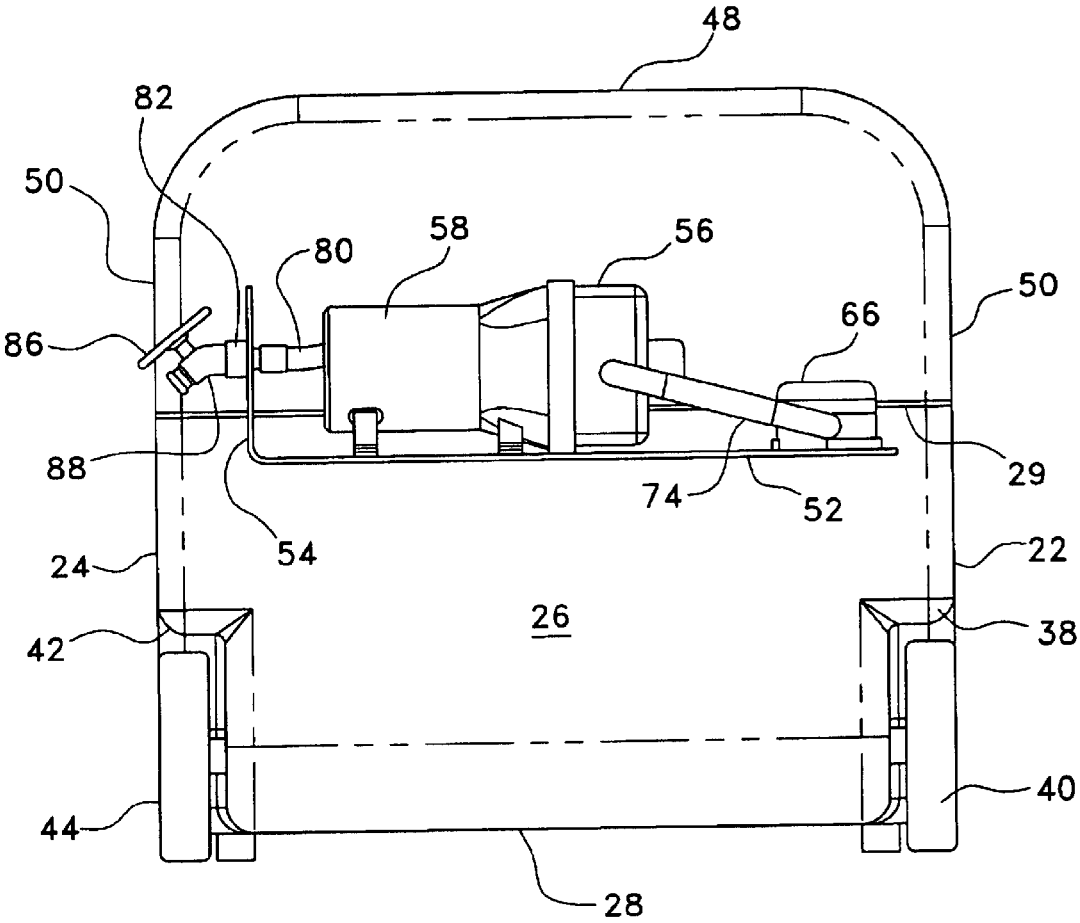
FIG. 4 is a rear elevation view of the system of FIG. 1.
Figure 5:
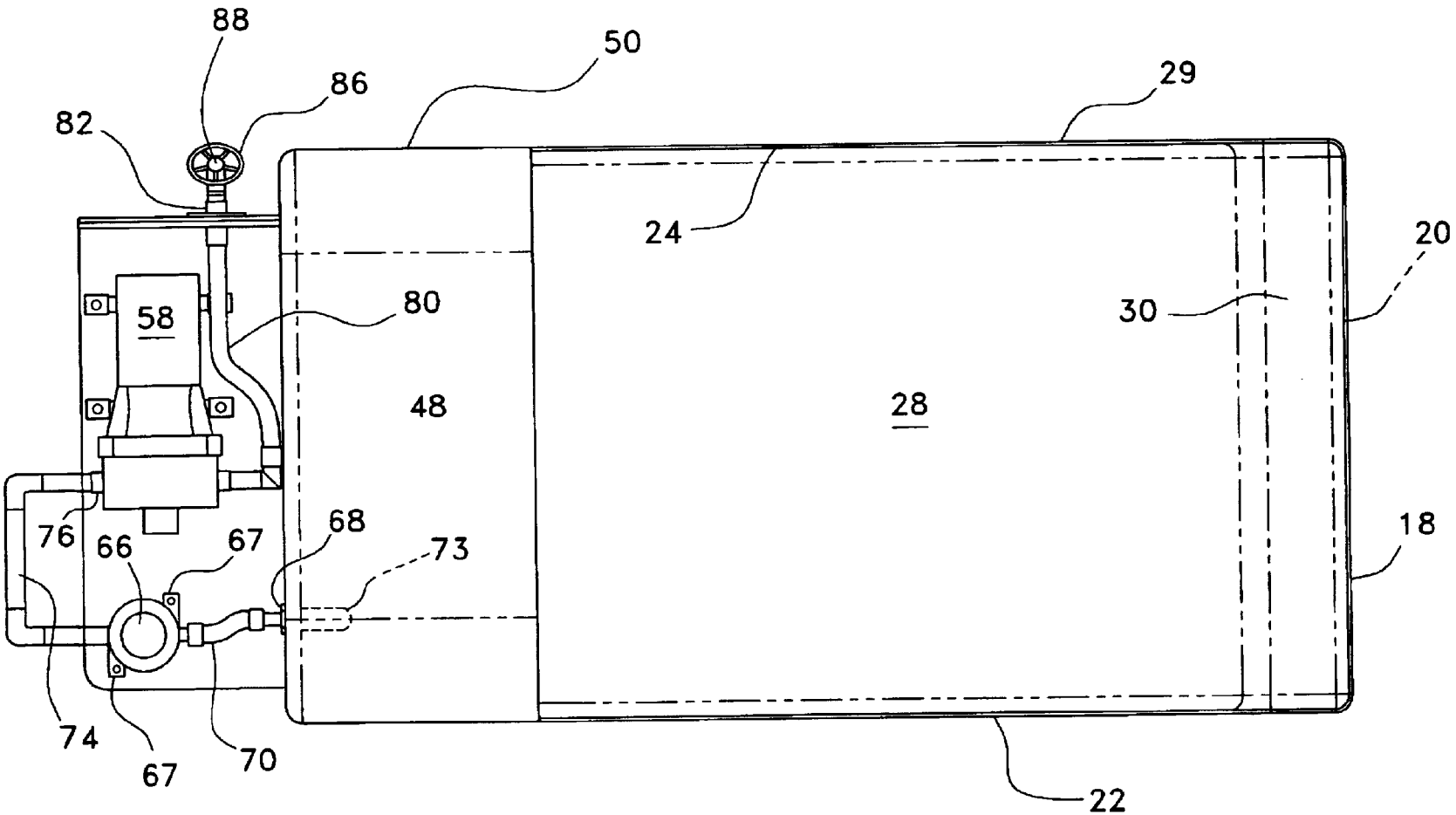
FIG. 5 is a plan view of the system of FIG. 1.
Figure 6:
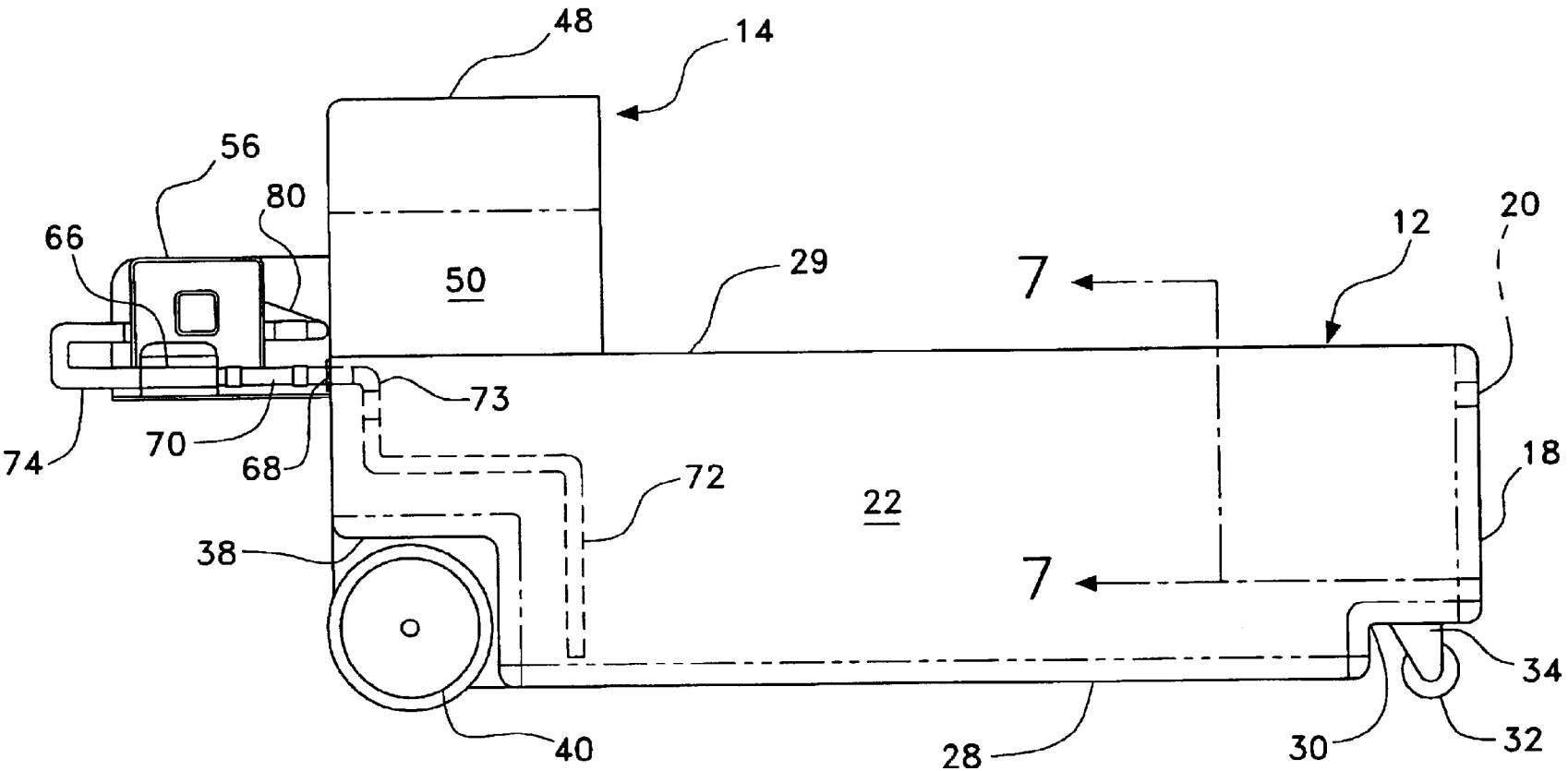
FIG. 6 is a left side elevation view of the system of FIG. 1.
Figure 7:
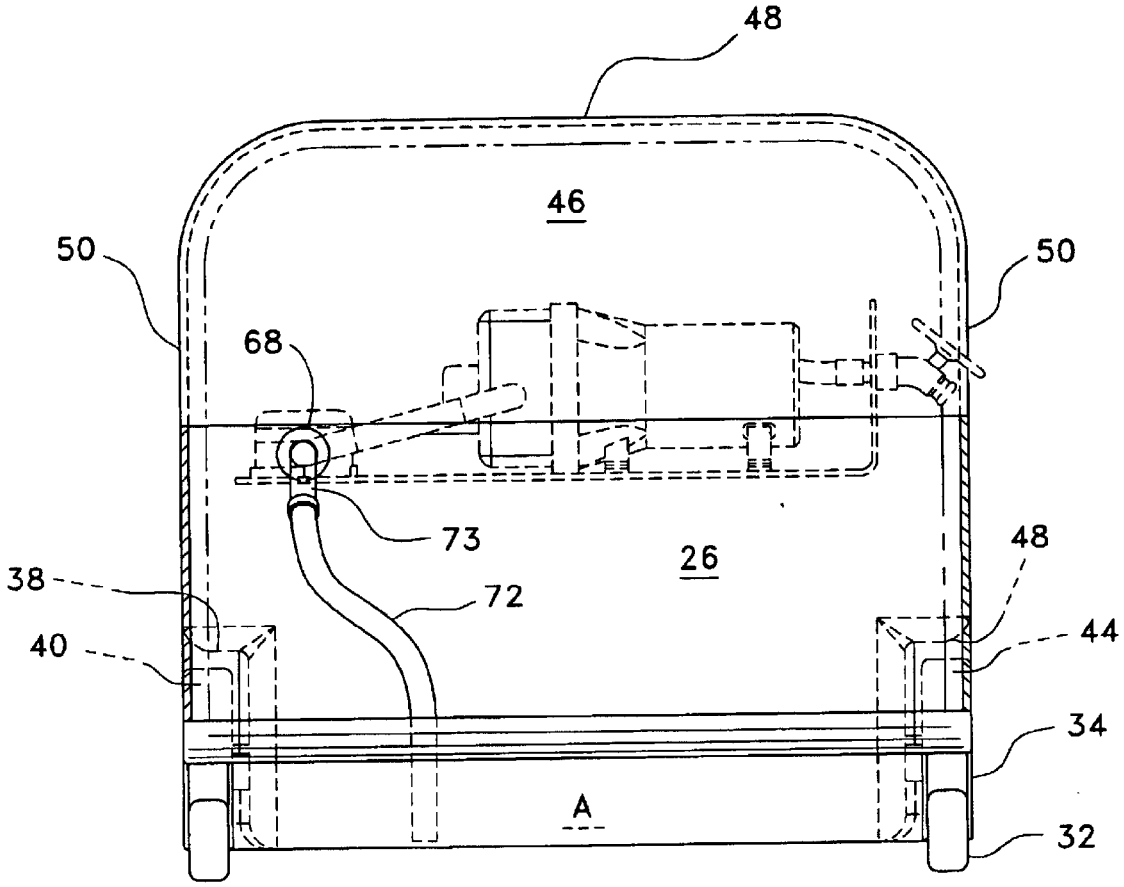
FIG. 7 is a partial sectional front view taken along lines 7—7 of FIG. 6.

As shown in FIG. 3, a 12-volt battery 110 may be substituted as a power supply, having battery clips 112, battery cable 114, and battery cable connectors 116 to connect mate with supply cord and connectors 65 in an identical manner. A high pressure flush hose 108(shorter than hose 80, although hose 80 may be employed for this purpose) is attached to "ear-muff type flush kit" (see U.S. Pat. No. 5,362,265 to Gervals, and U.S. Pat. No. 6,165,033, to Cugini, the disclosures of which are hereby incorporated by reference). The kit is a spring-like device and includes outdrive connectors(as shown placed on outdrive O) and a hose connector 106 for fluid connection with the outdrive O for flushing and winterizing the marine engine(not shown).

The present invention is useful in flushing a wide selection of commercial outdrives including, but not limited to Mercruiser, Alpha I, Bravo I,II,and III; OMC, Cobra, King; and Volvo, single prop, duo prop. Outboard motors serviced with the invention include Mercury Force Mariner, OMC Johnson Evinrude, Honda, Suzuki, and Yamaha.

Although the winterizing system of the present invention is described as a rectangular, molded plastic reservoir with circulating system, other shapes are contemplated. A 110 or 220-volt pump motor may be used with a plug-in cord if such power supply sources are readily available.

It is to be understood that the present invention is not limited to the embodiments described above, but encompasses any and all embodiments within the scope of the following claims.

I claim:

1. A personal marine winterizing system, comprising:

a portable reservoir having:

a front end wall having a handle thereon;

opposing side walls;

a rear end wall;

a bottom wall; and said front end wall and said side walls forming an upper lip;

a rearward opening, hood-like splash guard mounted on said reservoir extending upward from said rear end wall and rear portions of said portable reservoir; and an antifreeze solution circulating system mounted on said rear end wall and extending rearward from said end wall and said splash guard, said circulating system having a high pressure pump having an inlet and an outlet, a solution pickup extending through said end wall to said bottom wall so as to allow suction of said solution into said high pressure pump, and a high pressure fluid application supply hose fluidly connected with the outlet of said high pressure pump for supplying high pressure fluid to one of a marine engine and a boat fresh or marine water system;

wherein said rear wall includes a generally horizontal support wall extending rearward from said rear end wall and located so as to provide physical support for said circulating system.

2. The winterizing system of claim 1, wherein said reservoir is generally rectangular in shape, and has rear wheels mounted thereon on opposing sides of said reservoir and extending below said bottom wall for supporting said reservoir for movement of said system to a location for winterizing a boat.

3. The winterizing system of claim 2, wherein said reservoir has swivel wheels mounted thereon on opposing sides of said reservoir and extending below said bottom wall for supporting said reservoir for swivelable movement, allowing ease in location of said winterizing system relative to a boat stern or other portion.

4. The winterizing system of claim 1, wherein said circulating system includes a high pressure control valve fluidly connected with the outlet of said high pressure pump, said valve being connected with said fluid supply hose for controlling fluid flow between said pump and said fluid supply hose.

5. The winterizing system of claim 4, said horizontal support wall having a vertical valve support wall extending upward therefrom for supporting said high pressure control valve relative to said high pressure hose and said reservoir end wall.

6. The winterizing system of claim 5, said high pressure control valve being a faucet-like valve having a threaded or snap connect outlet, said supply hose being connected with said supply hose by a mating threaded connection or snap connect/disconnect fitting.

7. The winterizing system of claim 5, said circulating system having a strainer fluidly connected between said solution pickup and said high pressure pump inlet.

8. The winterizing system of claim 7, wherein said strainer is mounted to said circulating system support wall.

9. The winterizing system of claim 8, wherein said strainer is fluidly connected with said solution pickup by a through-wall fitting and a supply line.

10. The winterizing system of claim 9, wherein said solution pickup is a suction supply hose connected with said through-wall fitting by an elbow fitting.

11. The winterizing system of claim 8, further comprising a connecting hose connected between said strainer and said pump inlet by an inlet hose and a high pressure outlet hose connected between said pump outlet and said high pressure control valve.

12. The winterizing system of claim 1, further comprising an "ear muff" type connection connected with said fluid supply hose for fluid connection with a cooling water opening in the out drive of an inboard/outboard boat propulsion system for flushing said outdrive and the connected marine engine with flushing solution such as antifreeze solution.

13. The winterizing system of claim 1, further comprising an "ear muff" type connection connected with said fluid application supply hose for fluid connection with a cooling water opening in the drive portion of an outboard boat engine.

14. The winterizing system of claim 1, further comprising a control valve connected with said fluid application supply hose for fluid connection with a supply connector for connection with a marine engine cooling system or a boat fresh or marine water system.

15. The winterizing system of claim 14, wherein said control valve is a garden-type trigger spray valve.

16. The winterizing system of claim 14, further comprising a fluid return hose for connection with a marine engine or a boat fresh or marine boat water system for returning flushing fluid supplied by said high pressure application supply hose from said marine engine or boat water system to said reservoir, thus saving winterizing fluid for recirculation into said circulation system.

* * * * *